United States Patent [19]

Brooks

[11] Patent Number: 4,614,088

[45] Date of Patent: Sep. 30, 1986

[54] ICE PIECE EJECTION MECHANISM FOR ICEMAKER

[75] Inventor: Robert B. Brooks, Louisville, Ky.

[73] Assignee: General Electric Company, Louisville, Ky.

[21] Appl. No.: 741,844

[22] Filed: Jun. 6, 1985

[51] Int. Cl.[4] ..... F25C 1/04; F25C 5/08

[52] U.S. Cl. ..... 62/137; 62/344; 62/353

[58] Field of Search ..... 62/344, 353, 137, 71

[56] References Cited

U.S. PATENT DOCUMENTS

| | | | |
|---|---|---|---|
| 2,717,504 | 9/1955 | Knerr | 62/353 X |
| 2,912,835 | 11/1959 | Moder et al. | 62/353 X |
| 2,949,749 | 8/1960 | Reddi | 62/137 |
| 3,276,225 | 10/1966 | Linstromberg | 62/353 |
| 3,362,181 | 1/1968 | Linstromberg | 62/353 X |
| 3,390,543 | 7/1968 | Moreland, II et al. | 62/353 |
| 3,393,531 | 7/1968 | Parr | 62/353 |
| 3,449,921 | 6/1969 | Connors | 62/137 |
| 3,581,516 | 6/1971 | Buchser et al. | 62/137 |
| 3,678,701 | 7/1972 | Powell et al. | 62/353 |
| 3,892,105 | 7/1975 | Bernard | 62/353 |
| 3,955,442 | 10/1960 | Loewenthal | 62/353 X |

*Primary Examiner*—William E. Tapocai

*Attorney, Agent, or Firm*—Frederick P. Weidner; Radford M. Reams

[57] ABSTRACT

An icemaker including a freezer mold having a plurality of partitioned walls disposed within the mold to define a plurality of cavities in which water is to be frozen to form ice pieces having an edge portion. There is provided a stripper member disposed longitudinally along one side of the mold and having a portion thereof above the cavities and said portion having an upwardly depending ridge. The ejection of ice pieces from the mold is provided by a rotating ejector for rotatably moving the ice pieces to above the cavities and to continue rotating the ejector and moving the ice pieces onto the stripper member such that the edge portion of the ice pieces engage the upwardly depending ridge and are retained thereby. Continued rotation of the ejector pivots the ice pieces upwardly about the edge portion and past the vertical whereupon the ice pieces tumble off the stripper member laterally outward of the mold.

8 Claims, 8 Drawing Figures

ICE PIECE EJECTION MECHANISM FOR ICEMAKER

BACKGROUND OF THE INVENTION

This invention relates generally to an ice piece ejection mechanism for icemakers. In particular it relates to an icemaker with a mold that forms the ice pieces into crescent shaped pieces usually joined together by a thin web of ice and is an improvement upon the ejection mechanism of such an icemaker. Automatic icemakers of this type usually have an underlying bin into which the ice pieces fall when harvested from the icemaker mold. To prevent over filling the bin, the icemaker has a feeler arm which may be periodically lowered into the bin and raised to an elevated position. During each cycle of the icemaker the feeler arm is lowered and if it strikes ice pieces preventing it from reaching its lower position a switching arrangement prevents harvesting the ice pieces until the feeler arm can subsequently reach its lower position. In icemakers of the type involved it is desirable to eject the ice pieces from the crescent cube icemaker so that they fall further from the icemaker in lateral distance this prevents ice piece build up directly under the mold. It is also desirable that the ice pieces fall in a manner to maximize impact breakup of the thin webs of ice joining the ice pieces together. This allows for better operation of any automatic ice piece dispenser associated with the icemaker and the ice pieces ejected therefrom. Users of the ice pieces also prefer that they be in individual pieces. It is further desirable that the ice pieces fall into an underlying storage bin after the feeler arm of the icemaker is fully raised thus preventing later raising of the feeler arm causing ejected ice pieces to be pushed out of the storage bin during that motion.

The icemaker to which the present invention specifically relates is described in detail in U.S. Pat. No. 3,276,225 and one of the ways of ejecting ice pieces from such an icemaker is disclosed in U.S. Pat. No. 3,581,516. The problem with the ejecting means of U.S. Pat. No. 3,581,516 is that it actually uses a section of the feeler arm to retain the ice pieces until the feeler arm is raised. When released the ice pieces just slide into the bin and therefore have little tendency to break apart. In addition, the feeler arm has a complicated shape which makes it relatively expensive to manufacture and not well suited to various icemaker and dispensor arrangements.

By this invention the ice pieces being ejected from a crescent icemaker are delivered to an underlying storage bin such that they fall further from the icemaker in lateral distance than heretofore and they tumble end over end into the storage bin thus maximizing the force to aid in breaking the web between the ice pieces being ejected from the icemaker. Further with this invention the ice pieces are delayed in their ejection from the icemaker into the storage bin thus allowing time for the feeler arm to be in its raised position and therefore not be hampered in its operation due to the ice pieces falling on top of the feeler arm when in its down position.

SUMMARY OF THE INVENTION

The present invention relates to an icemaker comprising a freezer mold having a plurality of partitioned walls disposed within the mold to define a plurality of cavities in which water is to be frozen to form ice pieces having an edge portion. There is provided a stripper member disposed longitudinally along one side of the mold and having a portion thereof above the cavities, said portion having an upwardly depending ridge. There are means for ejecting the ice pieces from the mold including a rotating ejector for rotatably moving the ice pieces to above the cavities and to continue rotating the ejector and moving the ice pieces onto the stripper member such that the edge portion of the ice pieces engage the unwardly depending ridge and are retained thereby. The mechanism includes means to continue rotating the ejector to pivot the ice pieces upwardly about the edge portion and past the vertical whereupon the ice pieces tumble off the stripper member laterally outward of the mold and tumble in a downwardly direction into the underlying storage bin.

DESCRIPTION OF THE PREFERRED EMBODIMENT

Figure 1:
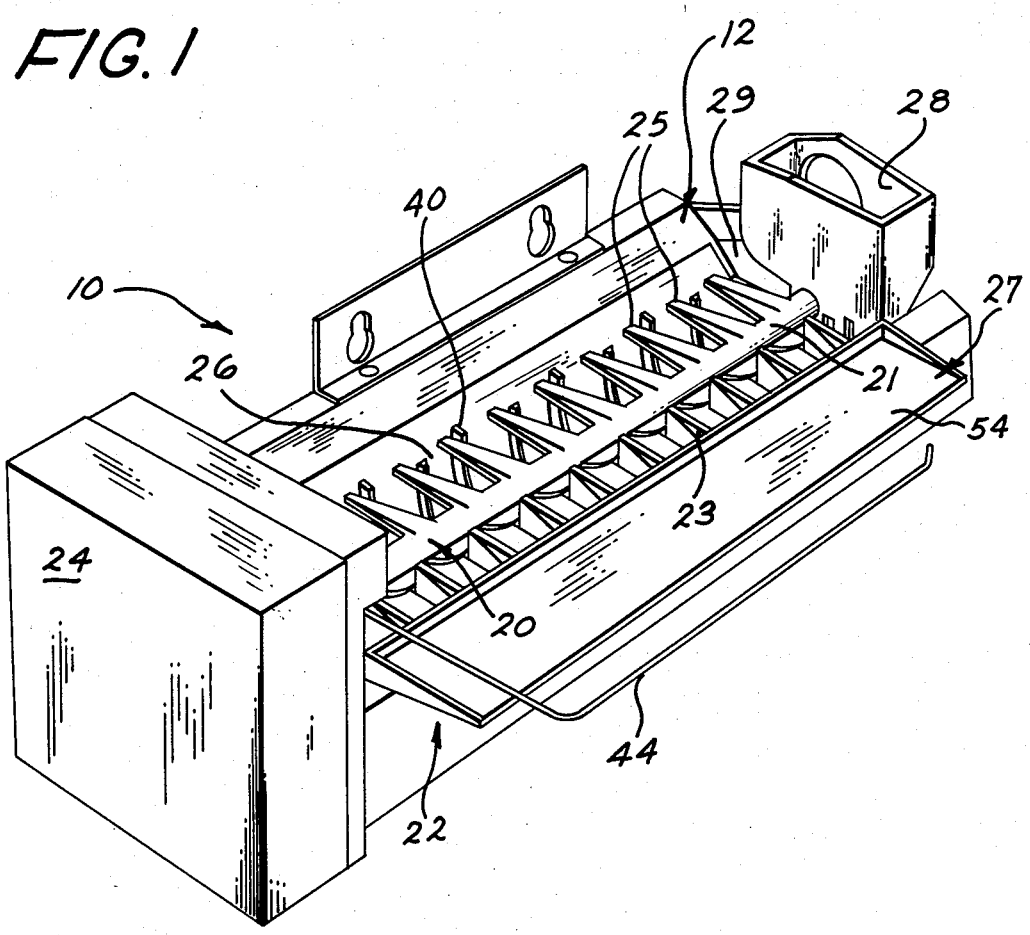
FIG. 1 is a perspective view of the icemaker embodying the present invention.

The icemaker 10 as shown in FIG. 1 includes a metal mold 12 in which the ice pieces 14 (FIG. 2) are formed and from which the ice pieces are ejected to a underlying storage bin 16 (FIG. 7) defining a collecting space 18 (FIG. 7) by means of an ejector 20 which sweeps through the mold during the ejection cycle. The ejector 20 has spaced projections 25, one for each of the ice pieces formed in the mold and when rotated the ejector 20 sweeps the ice pieces 14 out of the mold 12 and against a stripper member 22 which effectively strips the ice pieces 14 from the ejector 20. Stripper member 22 as shown in FIG. 3 particularly is made of a single plastic molded part and has tooth shaped projections 23 on one side projecting above and toward the center of the mold 12 and the other side has a downwardly declining portion 27 with an upper flat surface 54. The two sides of the stripper member 22 are separated by a longitudinal upwardly depending ridge 56. The stripper member 22 is secured to the mold 12 by any suitable means. Cyclical operation of ejector 20 is automatically effected by a control generally indicated 24 disposed at the forward end of the mold 12. In addition to cycling the ejector 20, control 24 further automatically provides for refilling the mold with water for susequent further ice piece formation therein. For a detailed description of the operation of the control 24, reference may be had to the hereinbefore identified U.S. Pat. No. 3,276,225. Mold 12 defines a plurality of upwardly opening cavities 26 in which ice pieces 14 are formed. The water from which the ice pieces are formed is delivered to mold 12 by means of an inlet 28 connected at one end to a trough 29 that empties into the mold 12 and the other end to a solenoid operated valve (not shown) through a suitable water delivery tube also not shown. It will be understood that the valve is connected to a suitable source of water under pressure for delivery of the water to the water inlet 28.

Figure 2:
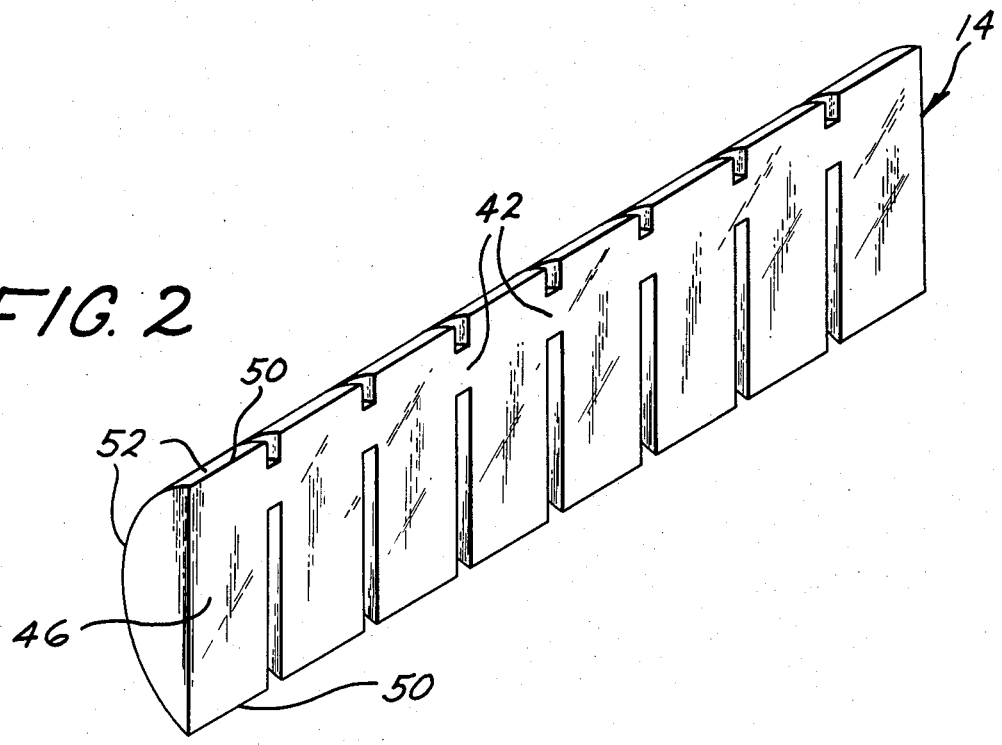
FIG. 2 is an array of crescent shaped ice pieces joined together by webs of ice of the type made in the icemaker shown in FIG. 1.
Figure 3:
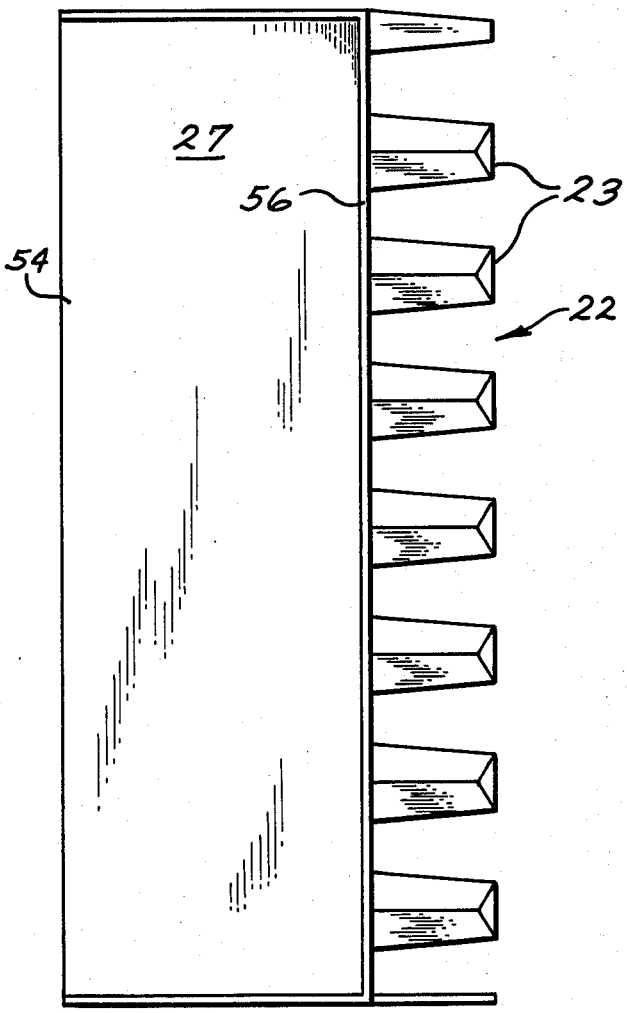
FIG. 3 is a top plan view of the icemaker stripper member used in the present invention.

With reference to FIGS. 1–4 the icemaker more specifically comprises a metal mold 12 with a tray structure having a bottom wall 30 and side walls 32 and 34. A sheathed heating element 36 is positioned by pressing into the bottom wall 30 to heat the mold 12 during the ejection operation to slightly melt the ice pieces and release them from the mold cavities 26, thus aiding in said ejection operation. A plurality of partition walls 38 extend transversely across the mold to define with the above-indicated tray walls the cavities 26 in which the ice pieces 14 are formed. Each of the partition walls 38 is provided with a recessed upper edge portion 41 through which water flows from the end cavity successively forward to the respective cavities until all the cavities are filled with water. As can be clearly seen in FIG. 2 a connecting ice portion or web 42 is formed on the ice pieces 14 where the recessed upper edge portion 41 of the partition walls 38 are located and the webs 42 are preferably sufficiently strong to prevent breaking of the ice piece during the normal ejection from the mold cavity 26. However, it is desirable that the ice pieces 14 be separated from each other upon delivery into the underlying storage bin 16. By the ejection mechanism of the present invention the ice pieces are broke apart at the webs 42 separating them as the result of the impact of the tumbling ice pieces into the underlying storage bin. The reason for separating the ice pieces into individual ice pieces if possible is so that subsequent dispensing of the ice pieces through an automatic dispenser is more readily accomplished and also the user of the ice pieces from the storage bin usually prefer that they be in separate form rather than in strips as shown in FIG. 2.

In order to sense the level of ice pieces 14 as they accumulate in the underlying storage bin 16 there is a feeler arm 44 and mechanism (not shown) actuated by control 24 for controlling the automatic harvesting operation so as to maintain a preselected level of ice pieces in the collecting space 18. The feeler arm 44 is automatically raised and lowered periodically during operation of the icemaker so that upon its being lowered into the underlying storage bin 16 should it encounter and be obstructed by the level of ice pieces in the storage bin preventing it from reaching its lowered position it will signal the icemaker control 24 to discontinue harvesting ice pieces because the bin 16 is full. Once the ice pieces 14 in the bin have been sufficiently removed and the feeler arm 44 can reach its lowered position the control signals the icemaker to initiate and continue making ice pieces and harvesting them until once again the feeler arm 44 detects ice pieces by obstruction when being moved to its lowered position. It will be appreciated that the feeler arm 44 is raised to an upper position and lowered to a lower position periodically and that it is desirable to have the feeler arm in its raised position during harvesting of the ice pieces so that the ice pieces do not fall or tumble onto the feeler arm in which event when the feeler arm 44 is raised it may cause the ice pieces to be shoved or moved outside the walls of the storage bin. Thus, another advantage of the present invention is that the ice pieces are not removed from the icemaker and delivered to the storage bin until the feeler arm 44 is in its upper or raised position.

Figure 4:
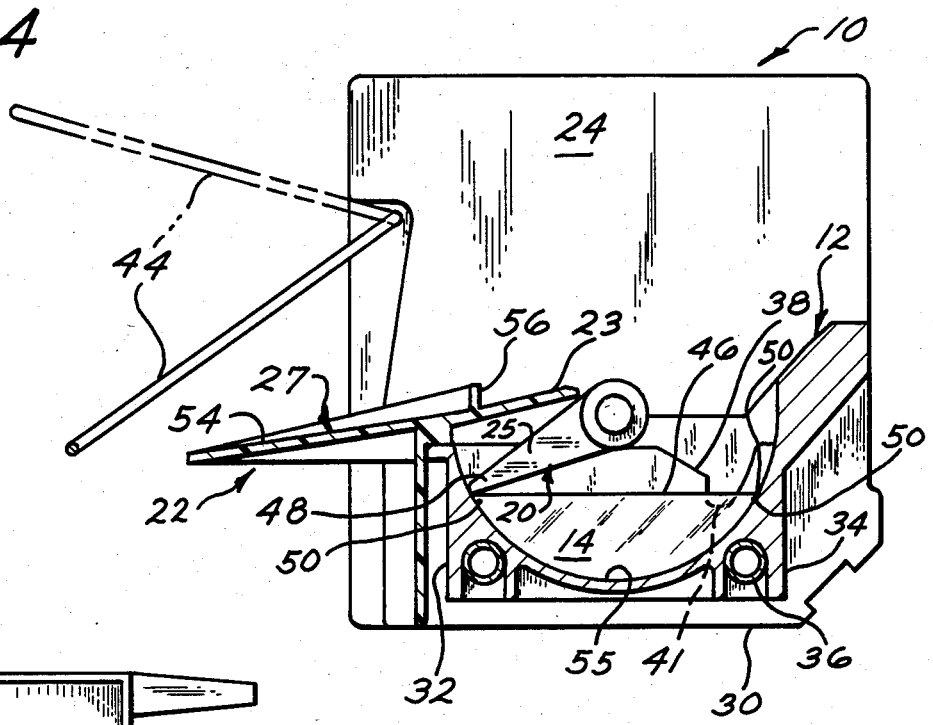
FIG. 4 is a cross-sectional view of the icemaker shown in FIG. 1 showing the first stage of ejecting the ice pieces from the icemaker and incorporating the details of the present invention.
Figure 5:
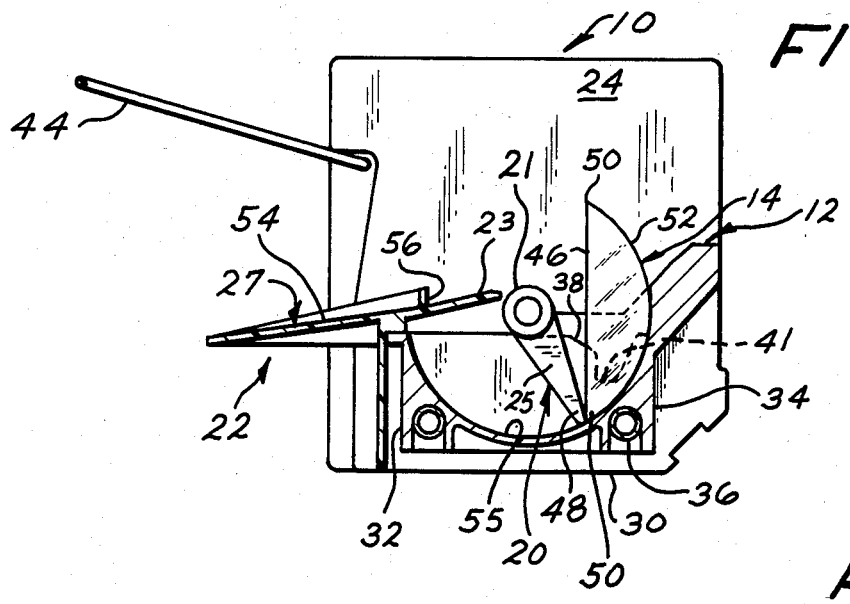
FIG. 5 is similar to FIG. 4 and showing the second stage of ejecting the ice pieces from the icemaker incorporating the present invention.

With reference to FIGS. 4–8 the ice piece harvesting operation will now be described. The ice piece harvesting operation is initiated by energization of heating element 36 to slightly melt the ice pieces 14 to release them from their respective mold cavities 26. Thereafter, the control and mechanism as shown in FIG. 4 causes counterclockwise rotation of the ejector 20 with the feeler arm 44 disposed in its lowered position shown in full line in FIG. 4 and dotted line in FIG. 8. As the ejector 20 continues to rotate, the feeler arm 44 is swung outwardly from the mold 12 and is raised to its uppermost position above the collection space 18 of the storage bin 16 as shown in dotted line in FIG. 4 and in full line in FIGS. 5–8 during the ice harvesting operation. Upon completion of the ice harvesting operation the control 24 causes the feeler arm 44 to be lowered to its position as shown in full line in FIG. 4 to sense whether or not the level of the ice pieces in the ice bin is high enough to obstruct its rotational movement to its lowered position and by appropriate signal means in case of obstruction the control terminates operation of the icemaker. As ejector 20 continues to rotate counterclockwise it forceably engages the upper flat surface or side 46 of the ice pieces and urge the ice pieces outwardly from the mold cavities 26 in a pivotal movement, as shown in FIGS. 4–8. As shown in FIG. 4 the first position or stage of the ice piece ejection operation is that the forward end 48 of ejector 20 engages the ice piece 14 near the forward edge portion 50 and because the heating element 36 has slightly melted the ice pieces they are released from the mold cavities 26 by the continued rotation of the ejector 20 in its counterclockwise motion and scoops the ice pieces from the cavities to a second position as shown in FIG. 5. It will be noted that the ice pieces 14 have a arcuate wall or side 52 that joins the flat side 46 at an edge portion 50 at both ends of the ice piece 14. It will be noted that the arcuate side 52 of the ice pieces 14 correspond with the arcuate mold cavity surface 55 thus allowing rotation of the ice piece outwardly from the cavity during rotation of the ejector 20 forcing the ice piece from the cavity.

Figure 6:
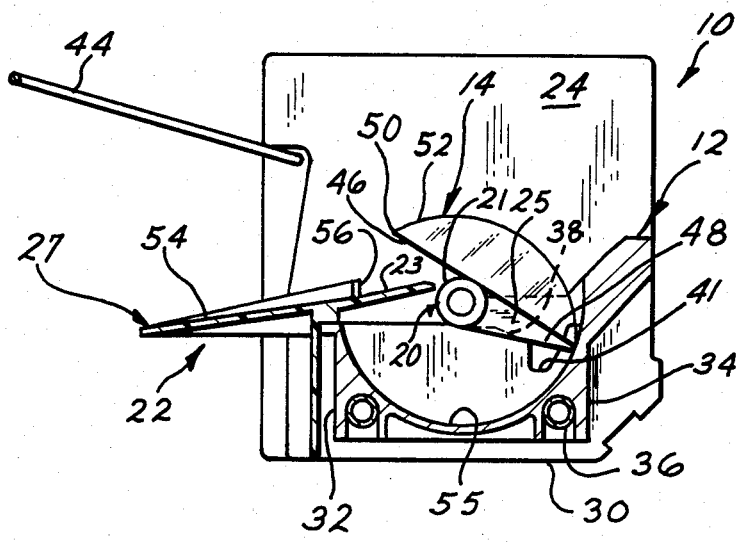
FIG. 6 is similar to FIGS. 4 and 5 and shows the third stage of ejecting the ice pieces from the icemaker incorporating the present invention.
Figure 7:
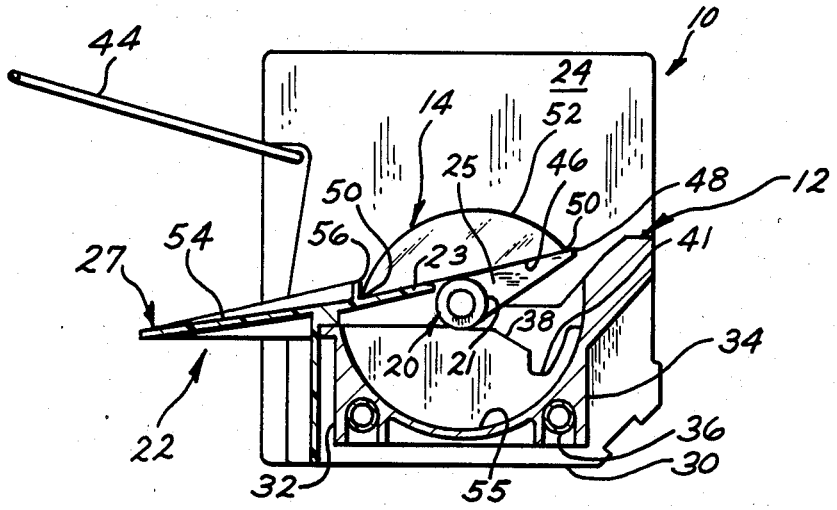
FIG. 7 is a cross-sectional view of the icemaker similar to FIGS. 4, 5 and 6 showing the fourth stage of ejecting ice pieces from the icemaker incorporating the present invention.
Figure 8:
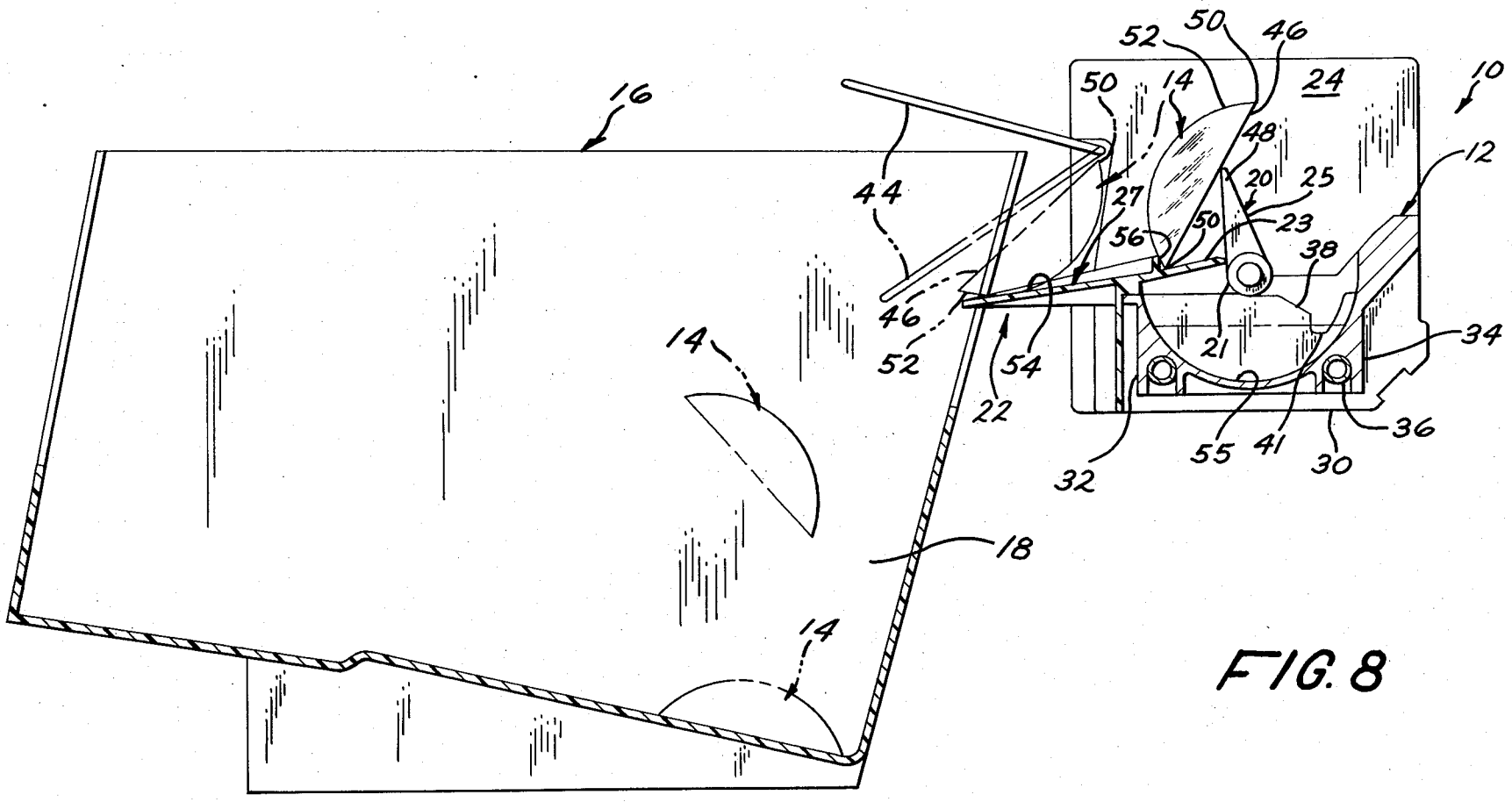
FIG. 8 is similar to FIGS. 4–7 showing the fifth stage of ejecting ice pieces from the icemaker incorporating the present invention and in addition showing the underlying ice piece storage bin.

The third position of the ice pieces 14 and mechanism during the ice harvesting operation is shown in FIG. 6 wherein the ice pieces 14 have been removed from the cavities 26 and have fallen onto the central rotating axle 21 of ejector 20 with the flat surface 46 of the ice piece lying across and contacting the axle 21. Continued counterclockwise movement of the ejector 20 causes the strip or array of ice pieces 14 to be further rotated to the fourth position and will engage the stripper member 22 as shown in FIG. 7. The stripper member 22 is secured to the mold 12 such that tooth shaped projections 23 extend over and above each of the partition walls 38. The projections 23 are spaced from each other a distance sufficient to allow the projections 25 of the ejector 20 to pass there between during its rotational movement, however, the spacing is not enough to allow the ice pieces through so they cannot re-enter the cavities from which they came. Stripper member 22 has a relatively flat surface 54 downwardly declining in a direction away from the mold 12 and has located at its surface overlying the mold an upwardly depending ridge 56 which is arranged such that the edge portion 50 of the ice pieces 14 engage the upwardly depending ridge 56 and the ice pieces are thereby retained from sliding off of the stripper member 22 in the fourth position. Heretofore icemakers of this type could have the ice pieces merely slide off of the stripper member 22 and fall directly into the storage bin 16 and in many occasions they fell onto the feeler arm 44 because it was still in its lowered position. By this invention the ice pieces 14 are delayed in being deposited into the storage bin 16 to allow the feeler arm to move to its raised position before the ice pieces tumble into the storage bin. Upon continued rotation of the ejector 20 the ice pieces are raised to the fifth position shown in FIG. 8 while the edge portion 50 of the ice piece is still being retained by the upwardly depending ridge 56. When the ejector 20 rotates far enough so that the ice pieces pivot about the edge portion 53 and past the vertical the ice pieces will tumble down the inclined surface 54 of the stripper member lateraly outward of the mold into the storage bin 16 as shown in FIG. 8. This tumbling action provides for additional force to be exerted on the webs 42 holding the ice pieces 14 together and upon impact with the storage bin or underlying ice pieces the fragile web of ice is broken and the ice pieces are separated. Once the ice pieces have been harvested from the mold 12 the control lowers the feeler arm 44 to determine if the icemaker should continue making ice pieces. If the feeler arm 44 is obstructed in its downward movement, then the icemaker by appropriate signal from the control terminates the icemaking process by failing to initiate the next subsequent harvesting cycle.

While there is shown and described the preferred embodiment of this invention, it is to be understood that it is capable of many modifications. Changes, therefore, in the construction and arrangement may be made without departing from the spirit and scope of the invention as defined in the appended claims.

What is claimed is:

1. An icemaker comprising:

a freezer mold having a plurality of partitioned walls disposed within the mold to define a plurality of cavities in which water is to be frozen to form ice pieces having a edge portion, means for ejecting the ice pieces from the mold including a rotating ejector with spaced projections and a longitudinal axis in a horizontal plane for rotatively moving the ice pieces to above the cavities, a relatively flat stripper member inclined downwardly in a direction away from the mold and disposed longitudinally along one side of the mold and having a portion with a free end extending outwardly from said one side of the mold and a portion extending above the cavities, said portion above the cavities having tooth shaped projections spaced from each other a distance sufficient to allow the projections of the ejector to pass therebetween during its rotational movement and having a longitudinal upwardly depending ridge located between the tooth shaped projections and the portion extending outwardly from said one side of the mold and in substantially the same horizontal plane as the longitudinal axis of the rotating ejector, means to continue rotating the ejector in the same direction and moving the ice pieces onto the stripper member such that the edge portion of the ice pieces engage the upwardly depending ridge and are retained thereby, and means to continue rotating the ejector in the same direction to pivot the ice pieces upwardly about the edge portion and past the vertical whereupon the ice pieces tuble off the stripper member laterally outward of the mold.

2. The icemaker of claim 1 wherein the rotating ejector is formed of a plastic material and includes a shaft and a plurality of fingers projecting transversely outwardly from said shaft, each of said fingers having a flat surface for applying an ejection force being in a common plane tangent to said shaft.

3. The icemaker of claim 1 wherein means are provided to heat the mold prior to ejecting the ice pieces from the mold.

4. The icemaker of claim 1 wherein there is an underlying receptacle to receive the ice pieces being ejected and tumbling off the stripper member of the mold.

5. The icemaker of claim 4 wherein means are provided for controlling the operation of the icemaker when the level of ice pieces in the receptacle rises above a pre-determined level.

6. The icemaker of claim 5 wherein the means to control the icemaker includes a feeler arm which may be raised and lowered and is in its raised position during the pivoting of the ice pieces upwardly about the edge portion and past the vertical whereupon they tumble off the stripper member laterally outward of the mold.

7. The icemaker of claim 1 wherein the ice pieces being ejected from the mold have a thin web of ice joining them together.

8. The icemaker of claim 1 wherein the ice pieces are crescent shaped having a flat side and an arcuate side joined to form the edge portion.

* * * * *